US005885909A

United States Patent [19]

Rudisill et al.

[11] Patent Number: 5,885,909

[45] Date of Patent: Mar. 23, 1999

[54] LOW OR SUB-DENIER NONWOVEN FIBROUS STRUCTURES

[75] Inventors: Edgar N. Rudisill, Hermitage, Tenn.; Hans Rudolf Edward Frankfort, Winterville, N.C.; Rudolph F. Janis, Richmond, Va.; Stephen Buckner Johnson, Wilmington, N.C.; David Jackson McGinty, Midlothian, Va.; H. Vaughn Samuelson, Chadds Ford, Pa.; Hyunkook Shin; George Vassilatos, both of Wilmington, Del.

[73] Assignee: E. I. du Pont de Nemours and Company, Wilmington, Del.

[21] Appl. No.: 868,529

[22] Filed: Jun. 4, 1997

Related U.S. Application Data

[60] Provisional application No. 60/019,277 Jun. 7, 1996.

[51] Int. Cl.[6] ..... B32B 27/04

[52] U.S. Cl. ..... 442/82; 442/334; 442/337; 442/340; 442/361; 442/364; 442/382

[58] Field of Search ..... 442/82, 334, 337, 442/340, 361, 364, 382; 428/373

[56] References Cited

U.S. PATENT DOCUMENTS

| | | | |
|---|---|---|---|
| 4,041,203 | 8/1977 | Brock et al. | 428/157 |
| 4,374,888 | 2/1983 | Bornslaeger | 428/198 |
| 4,442,161 | 4/1984 | Kirayoglu et al. | 428/219 |
| 4,499,139 | 2/1985 | Schortmann | 428/245 |
| 4,622,259 | 11/1986 | McAmish et al. | 428/171 |
| 4,908,163 | 3/1990 | McAmish et al. | 264/12 |
| 5,308,691 | 5/1994 | Lim et al. | 428/286 |
| 5,484,645 | 1/1996 | Lickfield et al. | 428/198 |
| 5,492,753 | 2/1996 | Levy et al. | 428/219 |
| 5,545,371 | 8/1996 | Lu | 264/555 |
| 5,605,739 | 2/1997 | Stokes et al. | 428/198 |
| 5,688,468 | 11/1997 | Lu | 264/555 |

FOREIGN PATENT DOCUMENTS

| | | | |
|---|---|---|---|
| 0 365 293 | 4/1990 | European Pat. Off. | D04H 3/16 |
| 0 674 035 | 9/1995 | European Pat. Off. | D04H 1/56 |
| 62-238822 | 10/1987 | Japan | D01F 6/92 |
| 1263221 | 2/1972 | United Kingdom | D01F 7/027 |
| WO 97/35053 | 9/1997 | WIPO | D01D 5/12 |

*Primary Examiner*—James J. Bell

[57] ABSTRACT

This invention relates to a new nonwoven material which has very high Frazier permeability while having substantial hydrostatic head liquid barrier properties. The material is comprised of fibers which are approximately one denier and finer fibers which have sufficient strength properties so as not to need a support scrim. The fabric is quite comfortable because of its breathability, quite soft because of its construction, and protective from liquids from rain to hazardous chemicals.

75 Claims, 6 Drawing Sheets

2GT MICROFIBERS AT HIGH SPEED
% BOIL-OFF SHRINKAGE
0
10
20
30
40
50
60
4000
4500
5000
5500
6000
6500
7000
7500
SPINNING SPEED, ypm 2GT MICROFIBERS AT HIGH SPEED
% ELONGATION TO BREAK
50
45
40
35
30
4000
4500
5000
5500
6000
6500
7000
7500
SPINNING SPEED, ypm

LOW OR SUB-DENIER NONWOVEN FIBROUS STRUCTURES

This application claims the benefit of U.S. provisional application Ser. No. 60/019,277 filed on Jun. 7, 1996.

FIELD OF THE INVENTION

This invention relates to nonwoven fibrous structures and more particularly to breathable fabrics and sheet structures formed by fibers which are held together without weaving or knitting.

BACKGROUND OF THE INVENTION

Nonwoven fibrous structures have been around for many years and today there are a number of different nonwoven technologies in commercial use. To illustrate the breadth of nonwoven technologies, paper is probably one of the earliest developed nonwoven fibrous structures. Nonwoven technologies continue to be developed by those seeking new applications and competitive advantages. One broad market area that has proven to be highly desirable because of its large volume and economics is the protective apparel market. This market comprises protection from hazardous chemicals such as in chemical spill clean up, from liquids such as blood in the medical field and from dry particulates or other hazards such as painting or asbestos removal. This market is served by a number of competing technologies.

Focusing simply on the medical protective apparel market, E. I. du Pont de Nemours and Company (DuPont) makes Sontara® spunlaced fabrics which are used extensively for medical gowns and drapes and, for certain applications within the medical field, Tyvek® spunbonded olefin.

Sontara® spunlaced fabrics have long been used in the medical field because of their exceptional performance and comfort. Sontara® spunlaced fabrics for medical protective apparel uses are typically comprised staple length polyester fiber hydroentangled with woodpulp. The fabric is finished with a moisture repellent coating to render it strike through moisture resistant.

Tyvek® spunbonded olefin is particularly useful in medical packaging where it provides valuable advantages such as permitting sterilization in the package. It also is extremely low Tinting thereby minimizing contamination in the operating room.

Other technologies that compete in the medical field include composite or laminated products. The composite provides a balance of properties suitable for the end use. One competitive technology is generally called "SMS" in the industry for Spunbond/Meltblown/Spunbond. The basic SMS nonwoven material is described in U.S. Pat. No. 4,041,203 with further improvements described in U.S. Pat. Nos. 4,374,888 and 4,041,203. The spunbond outer layers are comprised of spunbond nonwoven which provides strength but is not able to attain the barrier properties of the meltblown inner layer. The technology for making meltblown fibers is swell suited to making fine low denier fibers which are able to have barrier and breathability but is not suited to obtaining suitable strength to withstand use as a garment.

U.S. Pat. Nos. 4,622,259 and 4,908,163 are directed to an improvement over SMS technology by making the meltblown fibers with improved tensile properties. By providing better meltblown fibers, one may avoid applying the scrim reinforcement and obtain a lighter weight fabric.

It is an object of the present invention to provide a further improved nonwoven structure which has a balance of properties which are better suited to barrier end uses.

It is further object of the present invention to provide a nonwoven structure that has more substantial barrier and breathability properties compared to currently known barrier materials.

SUMMARY OF THE INVENTION

The above and other objects of the invention are achieved by a flexible sheet material having a Frazier permeability of at least about 70 $m^3$/min-$m^2$ and an unsupported hydrostatic head of at least about 15 centimeters.

The invention further relates to a flexible sheet material having a Frazier permeability of at least about 28 $m^3$/min-$m^2$ and an unsupported hydrostatic head of at least about 30 centimeters.

The invention also relates to a flexible sheet material having a Frazier permeability of at least about 15 $m^3$/min-$m^2$ and a hydrostatic head of at least about 40 centimeters.

The invention includes a flexible sheet material having a Frazier permeability of at least about 1 $m^3$/min-$m^2$ and a hydrostatic head of at least about 80 centimeters.

In another aspect the invention comprises a flexible sheet material comprised of meltspun nonwoven fibers having an average length of at least about 4 cm with a cross section of a substantial majority of the fibers is less than 70 $\mu m^2$ and the average fiber strength is at least 275 N/$mm^2$.

In a still further aspect, the invention comprises a flexible sheet material formed of nonwoven fibers where in the sheet has a basis weight of at least about 13 g/$m^2$ and up to about 75 g/$m^2$, and wherein substantially all of the fibers are continuous meltspun fibers, a substantial majority by weight of the fibers have a cross section of less than about 90 microns, and wherein the sheet material has a Frazier permeability of at least about 1 $m^3$/min-$m^2$ and a hydrostatic head of at least about 25 centimeters.

The invention further relates to a radiation sterilization stable sheath-core multi-component fiber suited for making a thermally bonded nonwoven fabric wherein the core polymer is polyethylene teraphthalate and the sheath fiber is polypropylene teraphthalate.

BRIEF DESCRIPTION OF THE DRAWINGS

The invention will be more easily understood by a detailed explanation of the invention including drawings. Accordingly, drawings which are particularly suited for explaining the invention are attached herewith; however, it should be understood that such drawings are for explanation only and are not necessarily to scale. The drawings are briefly described as follows.

DETAILED DESCRIPTION OF THE PREFERRED EMBODIMENTS

Figure 1:
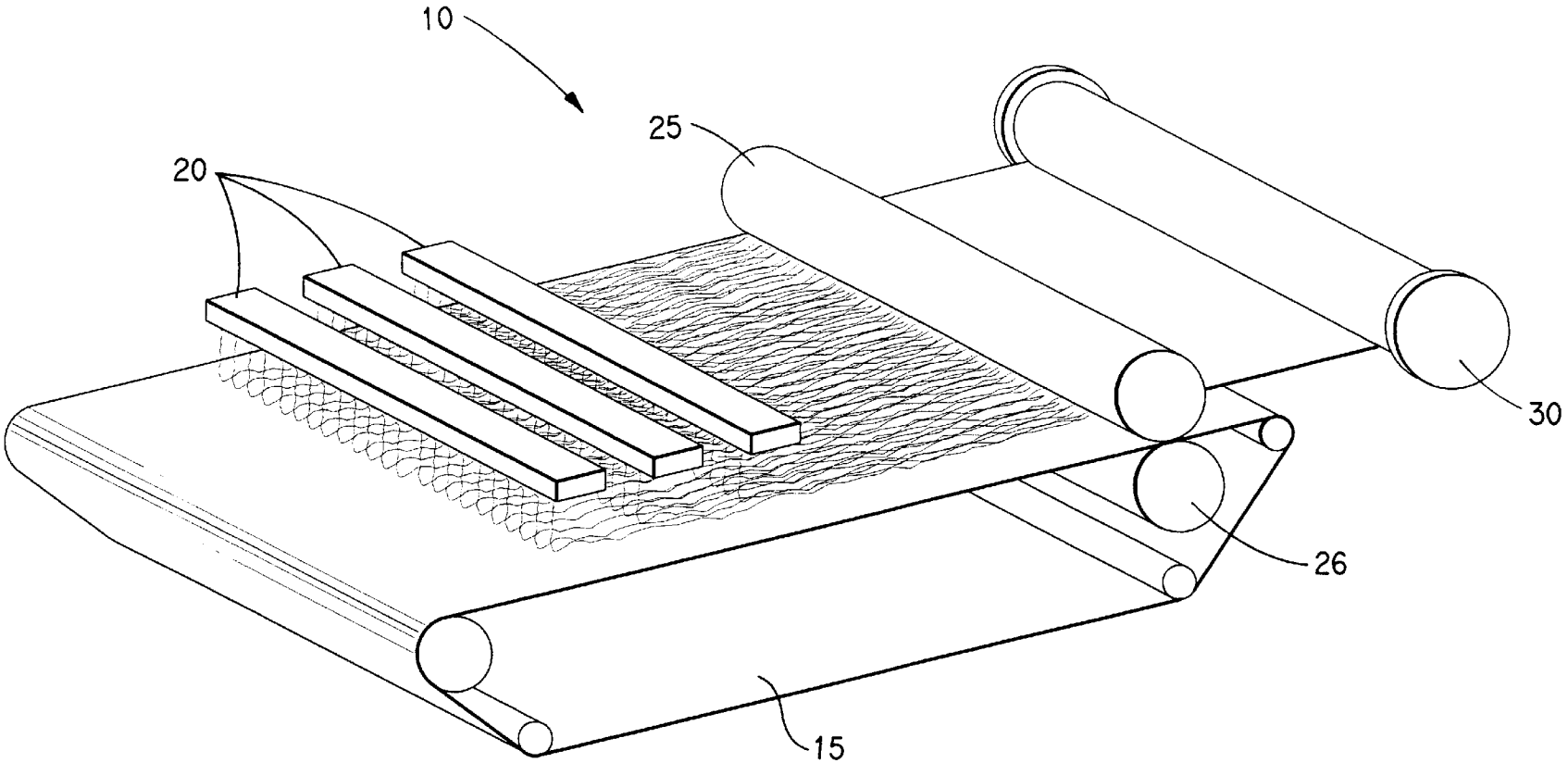
FIG. 1 is a perspective view of a first preferred embodiment for making the inventive fabric.

Turning now to the drawings there are a number of alternative techniques for making the inventive materials. In FIG. 1, there is illustrated a first preferred embodiment of a meltspun low denier spinning system, generally referred to by the number 10 for making a continuous roll of fabric. The system 10 comprises a continuous belt 15 running over a series of rollers. The belt 15 includes a generally horizontal run under a series of one or more spinning beams 20. In each spinning beam 20 is provided molten polymer and a large number of very small holes. The polymer exits through the holes forming a single fiber at each hole. The fibers are preferably hard yarn fibers which are strong and resist shrinkage. Typically, hard yarn fibers are made by quenching and drawing the fibers after they are spun so that the polymer chains are oriented within the fiber. It has been found, as will be described below, that hard yarn fibers may also be made by high speed spinning. Such high speed spinning may be the key to suitable fiber properties as well as suitable productivity to make the fabric price competitive.

Once the strong fibers have been formed, the fast moving and very fine fibers are directed to the moving belt 15. This is no small task due to the number of fibers and their reactivity to the turbulent air forces in the vicinity. Suitable guides, preferably including air baffles, are provided to maintain some control as the fibers are randomly arranged on the belt 15. One additional alternative for controlling the fibers may be to electrostatically charge the fibers and perhaps oppositely charge the belt 15 so that the fibers will be pinned to the belt once they are laid down. The web of fibers are thereafter bonded together to form the fabric. The bonding may be accomplished by any suitable technique including thermal bonding or adhesive bonding. Hot air bonding and ultrasonic bonding may provide attractive alternatives, but thermal bonding with the illustrated pinch rolls 25 and 26 is probably preferred. It is also recognized that the sheet material may be point bonded for many applications to provide a fabric like hand and feel, although there may be other end uses for which it is preferred that the sheet be area bonded with a smoother finish. With the point bonding finish, the bonding pattern and percentage of the sheet material bonded will be dictated so as to control fiber liberation and pilling as well as other considerations. The fabric is then rolled up on a roll 30 for storage and subsequent finishing as desired.

Figure 2:
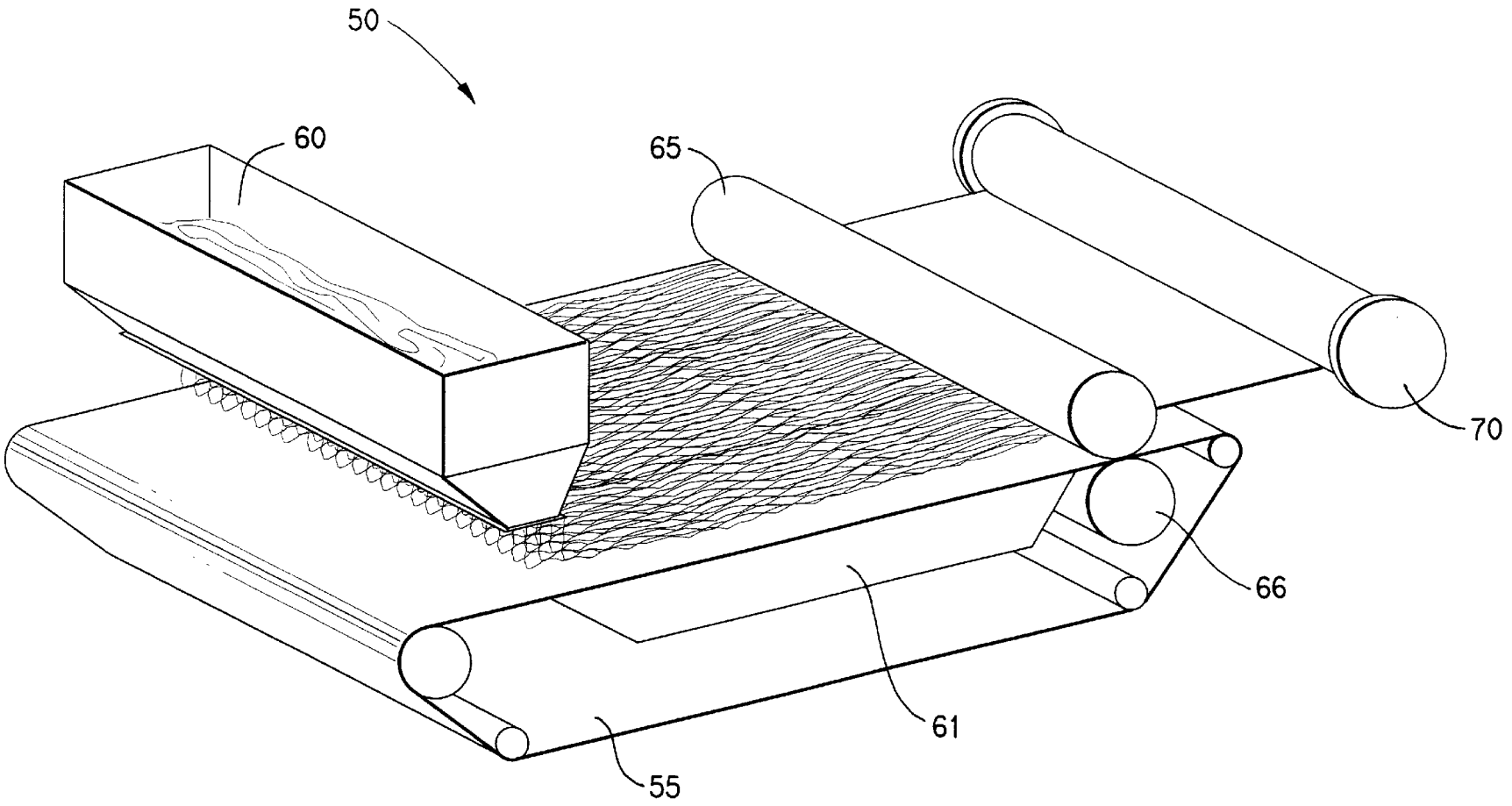
FIG. 2 is a perspective view of a second preferred embodiment for making the inventive fabric.

A second arrangement for making the inventive material of the present invention is shown in FIG. 2. In FIG. 2, there is shown a wetlay nonwoven fabric forming system generally referred to by the number 50. The wet lay system 50 includes a foraminous or screen belt 55 running over a series of rollers. A trough 60 is arranged over the belt 55 to deposit a slurry of liquid and discontinuous fiber thereon. As the slurry moves along with the belt 55, the liquid passes through the openings in the belt 55 and into a pan 61 (also called a pit). The fiber is randomly arranged and is bonded together at the pinch rollers 65 and 66. It should be recognized that there are a number of techniques for bonding the fibers together including through air bonding, resin bonding as well as other suitable bonding techniques. The nonwoven fabric is then rolled up on a roll 70 for storage or subsequent finishing.

The fiber in the inventive fabric is a small denier polymeric fiber which forms numerous, but very small pores. Putting small denier fiber in a fabric to obtain high barrier is generally known in the art and is not new. However, it has been found that when hard yarn meltspun microfibers are used to create a nonwoven fibrous structure, the resulting fabrics have extraordinarily high Frazier permeability. This is new.

It also appears that meltspun microfibers have sufficient strength to form a barrier fabric without the need for any type of supporting scrim thus saving the additional materials and cost of such supporting materials. While strength will be an important consideration to a buyer of such materials, stability will also be important. It has be found that microfibers may be meltspun at high speed that has low shrinkage. A fabric having high barrier and permeability properties that is strong and stable will have substantial value to makers and wearers of protective garments.

Figure 3:
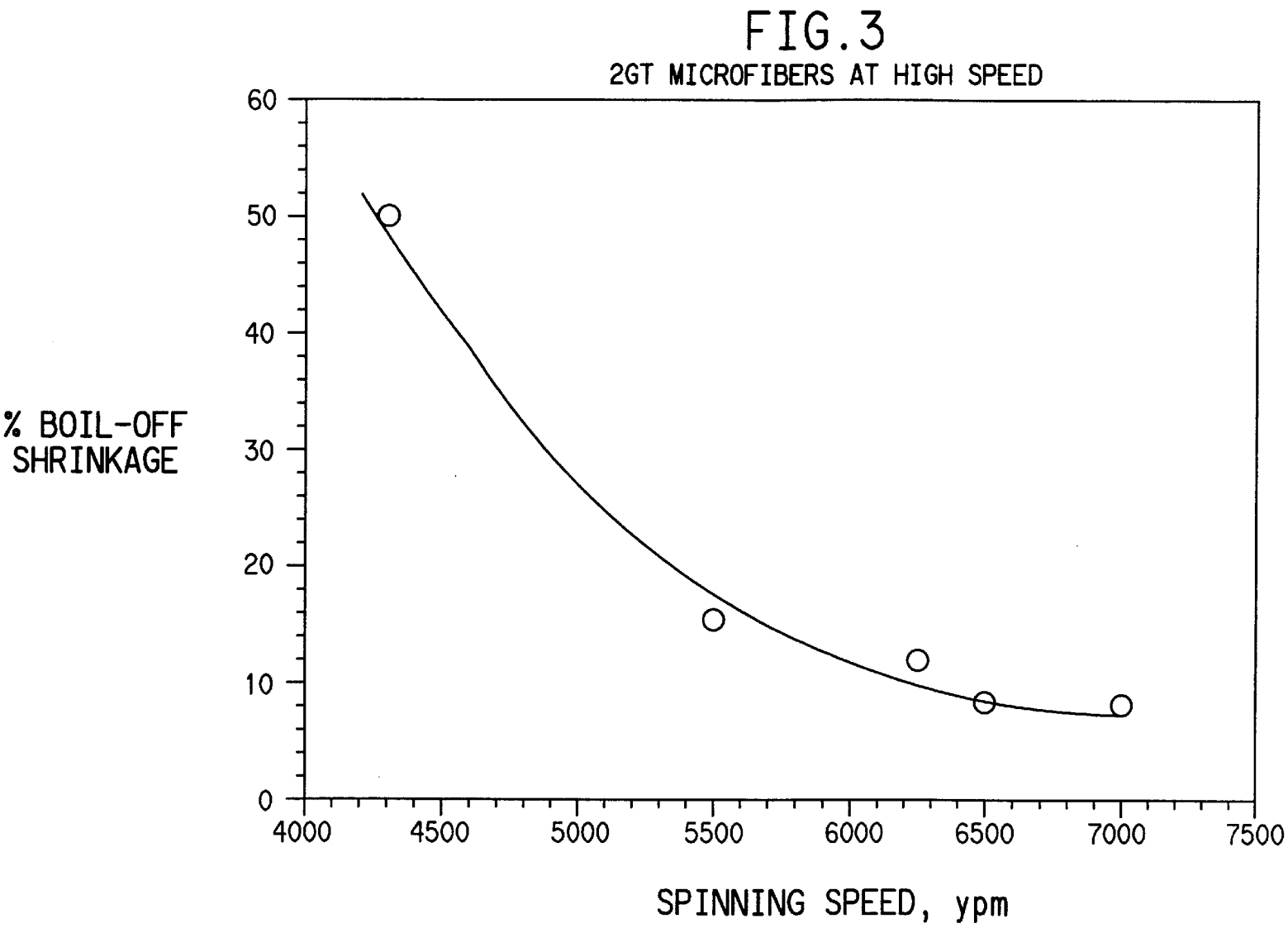
FIG. 3 is a chart illustrating one of the properties of the inventive fiber of the present invention.
Figure 4:
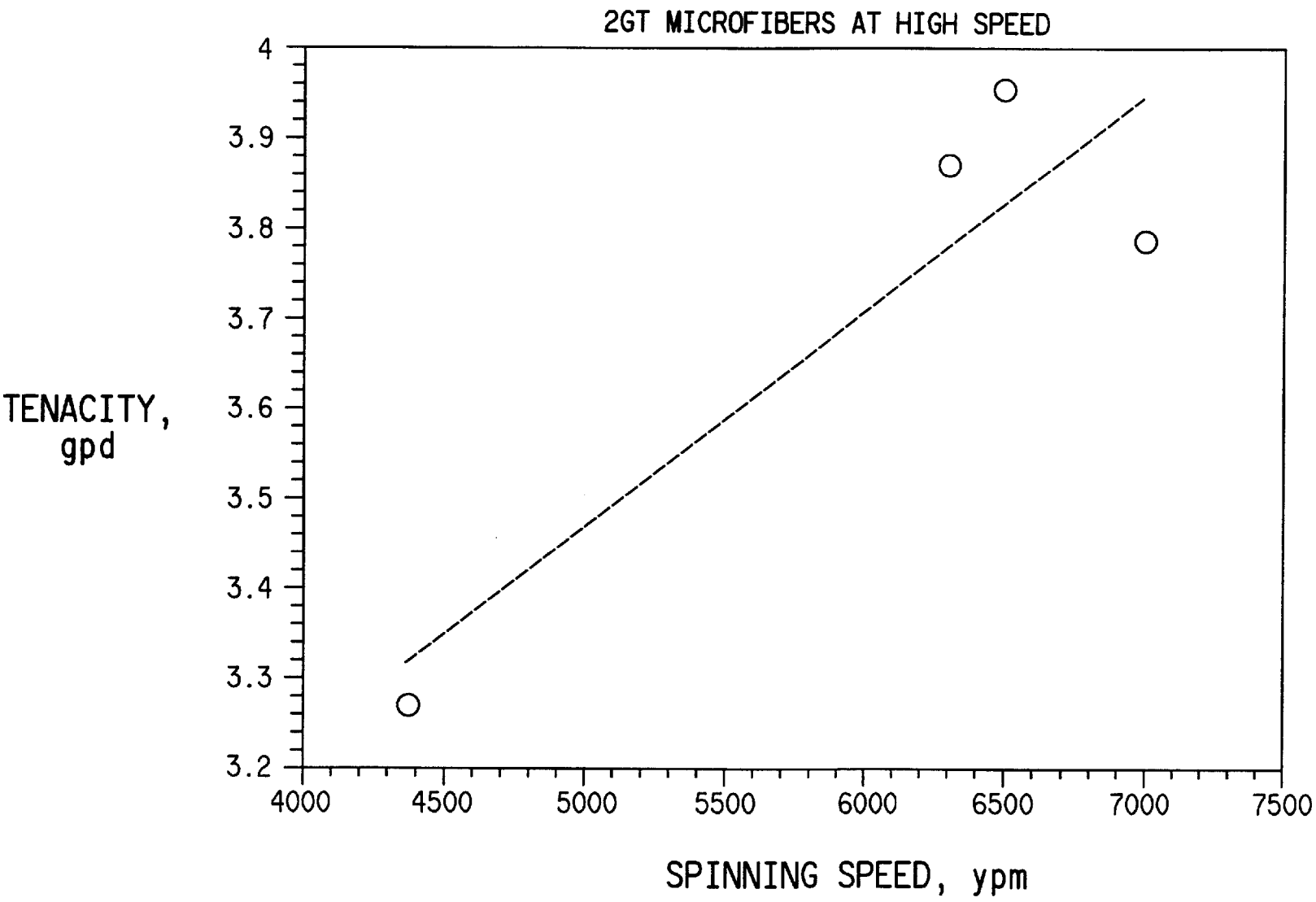
FIG. 4 is second chart illustrating a second property of the inventive fiber of the present invention.
Figure 5:
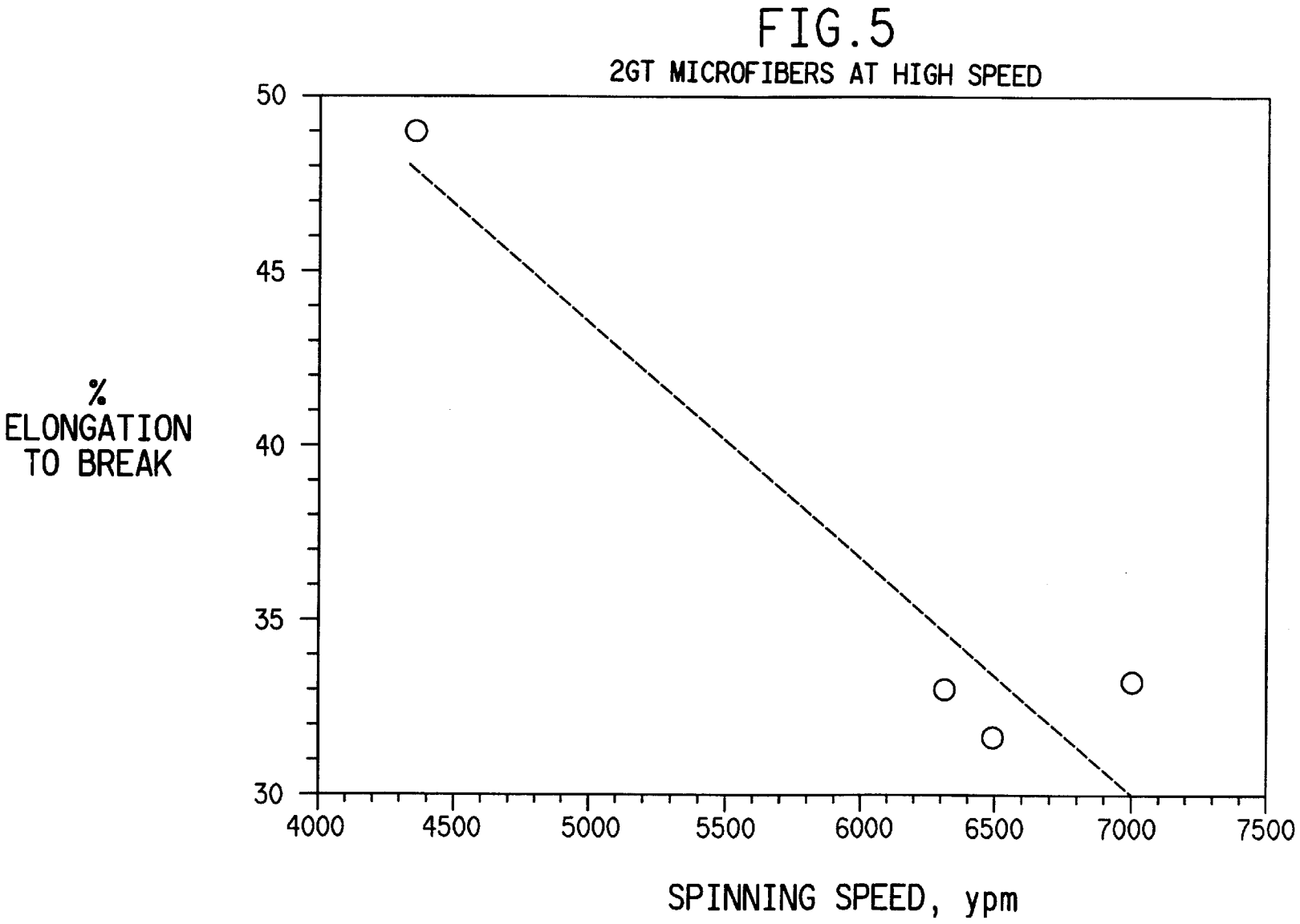
FIG. 5 is a third chart illustrating a third property of the inventive fiber of the present invention.

A potential key component for the success of the present invention to a nonwoven fabric may be in the creation of a hardened meltspun microfiber that is created without the steps of annealing and drawing. In particular, it has been found that spinning microfibers at high spinning speeds causes considerable changes in the properties of the fibers. Experiments were tested with 2GT polyester at a range of spinning speeds to show the effect of the spinning speed differences on the properties. As illustrated in the charts in FIGS. 3, 4, and 5, the tenacity dramatically increases, while the elongation to break and boil off shrinkage dramatically decrease. The data is also tabulated in the following Table A:

TABLE A

| | | | | | |
|---|---|---|---|---|---|
| Spinning Speed (m/min) | 3998 | 5029 | 5761 | 5943 | 6401 |
| No. of Filaments | 200 | 200 | 200 | 200 | 200 |
| Fiber Size (denier) | 0.5 | 0.5 | 0.5 | 0.5 | 0.5 |
| Boil Off Shrinkage (%) | 50.1 | 15.1 | 12.1 | 7.8 | 8.1 |
| Tenacity (g/denier) | 3.3 | — | 3.9 | 3.9 | 3.8 |
| Elongation to Break (%) | 49.0 | — | 33.0 | 31.8 | 33.2 |

It should be fairly clear that microfibers made at high spinning speeds will obviate the need for annealing and drawing. The microfibers are strong and stable. Such high production speeds will be desirable for high productive rates of nonwoven fabrics although the handling of such small fibers will be a challenge for any commercial installation.

In Tables B–D below, there is more data to confirm the foregoing data. The next group includes round cross sections polyester as well as bi-lobe cross sections:

TABLE B

| | | | | | |
|---|---|---|---|---|---|
| Spinning Speed (m/min) | 2743 | 3200 | 3658 | 4115 | 4115 |
| No. of Filaments | 100 | 100 | 100 | 100 | 100 |
| Fiber Size (denier) | 0.7 | 0.7 | 0.7 | 0.63 | 0.55 |
| Cross Section | Round | Round | Round | Round | Round |
| Boil Off Shrinkage (%) | 34 | 18 | 5.8 | 4.0 | 4.2 |
| Tenacity (g/denier) | 2.7 | 3.0 | — | 3.2 | 3.3 |
| Elongation to Break (%) | 119 | 108 | 91 | 80 | 80 |

TABLE C

| | | | | | |
|---|---|---|---|---|---|
| Spinning Speed (m/min) | 3658 | 4435 | 3200 | 3658 | 4115 |
| No. of Filaments | 100 | 100 | 100 | 100 | 100 |
| Fiber Size (denier) | 0.63 | 0.55 | 0.72 | 0.78 | 0.48 |
| Cross Section | Round | Round | Bi-Lobe | Bi-Lobe | Bi-Lobe |
| Boil Off Shrinkage (%) | 5.5 | 4.2 | 7.1 | 7.6 | 4.1 |
| Tenacity (g/denier) | 3.0 | 3.1 | 3.0 | 3.1 | 3.4 |
| Elongation to Break (%) | 86 | 70 | 102 | 96 | 75 |

TABLE D

| | | |
|---|---|---|
| Spinning Speed (m/min) | 3200 | 3200 |
| No. of Filaments | 68 | 100 |
| Fiber Size (denier) | 0.78 | 0.53 |
| Cross Section | Round | Round |
| Boil Off Shrinkage (%) | 4.9 | 4.5 |
| Dry Heat Shrinkage (%) | 4.4 | 4.3 |
| Tenacity (g/denier) | 3.3 | 3.0 |
| Elongation to Break (%) | 132 | 103 |

Clearly, it is an improvement in the art to provide fiber at a higher rate with desired properties that are obtained without the ordinary additional processing. It is particularly advantageous in the context of the improved nonwoven fabric.

In one aspect of the invention, the fabric may be subjected to a cold nip to compress the fabric. Under microscopic analysis, the fibers in the compressed fabric appear to be stacked on one another without having lost the basic cross sectional shape of the fiber. It appears that this is a relevant aspect of the invention since each fiber appears to have not been distorted or substantially flattened which would close the pores. As a result, the fabric has an increase in the barrier properties as measured by hydrostatic head seems to maintain a high void ratio and low density and very high Frazier permeability.

From a macroscopic analysis, the inventive fabrics are generally characterized have a balance of tremendously high Frazier permeability while exhibiting substantial hydrostatic head pressures. For example in some test fabrics the initial hydrostatic head may be at a level that is about 30 cm while the Frazier is above 65 $m^3$/min-$m^2$. The Frazier permeability and Hydrostatic head may be readily modified simply by cold calendering the inventive fabric. After calendering, the hydrostatic head may be brought up to as much as 45 to 50 cm while the Frazier remains in excess of 25 $m^3$/min-$m^2$. A fabric having high barrier properties with high breathability is believed to be highly desirable as a protective fabric in the medical field and possibly many other fields.

While the description of the invention has thus far been related to meltspun fibers which are only recently being made in the sub-denier sizes; however, there may be other spinning technologies either now developed or yet to be invented that could provide suitable polymeric fibers. The general range of preferred fibers have cross sectional sizes of between about 6 and about 90 $\mu m^2$ where fibers having a range from about 20 to about 70 $\mu m^2$ is more preferred and a range of about 33 to about 54 $\mu m^2$ is most preferred. Fiber sizes are conventionally described as denier or decitex. In the present circumstance, it is believed that the properties are achieved in part by a function of the physical size of the fibers. As denier and decitex relate to the weight of a long length of fiber, the density of the polymer may create some misleading information. For example, if two fibers have the same cross section, but one is made of polyethylene while the other comprises polyester, the polyester would have a greater denier since it tends to be more dense than polyethylene. However, it can generally be regarded that the preferred range of fiber denier is less than or nearly equal to about 1.

As noted above the fiber should be a hardened fiber. The cross sectional shape is not yet believed to be critical to the invention, but most compact cross sections are presumed to be best as the pores will most likely be small but not closed. Clearly, there may be some enhancements to the fabrics of the present invention by various cross sectional shapes of the fibers. At the same time, the fibers are preferred to have sufficient tensile strength that a support layer is not required. This is probably achieved by being composed of fibers having a minimum strength of at least about 275 MPa. Such fiber should easily provide sheet grab strengths in excess of 1 N/g/$m^2$ normalized for basis weight. The fiber strength of the present invention will accommodate most applications without reinforcement such as the meltblown layer in SMS. Melt blown fibers typically have tensile strengths from about 26 to about 42 MPa due to the lack of polymer orientation in the fiber. In this application, hydrostatic head pressures are measured on the various sheet examples in an unsupported manner so that if the sheets do not comprise a sufficient number of strong fibers, the measurement is not attainable. Thus, unsupported hydrostatic head pressure is a measure of barrier as well as an indication that the sheet has the intrinsic strength to support the hydrostatic head pressure.

It should be recognized that although the inventive fabric has been characterized by hydrostatic head, that the small pores will make a good barrier for dry particulate materials. Thus, with the high Frazier permeability that the fabric may be suitable for some filter applications. It should be recognized that basis weight of the sheet material will have some effect on the balance of hydrostatic head and permeability. In most cases, it will be desirable from both an economic and productivity standpoint as well as property balance standpoint to have the basis weight be about or below 75 g/$m^2$. However, there are potential end uses where heavier and higher barrier sheet materials would be desirable such as certain protective apparel applications, for example. In such cases, the basis weight may be greater than about 70 g/$m^2$ and could be quite heavy such 200 g/$m^2$, for example.

The preferred fiber would be any of a variety of polymers or copolymers including polyethylene, polypropylene, polyester, and any other melt spinnable fiber which would be less than approximately 1.2 decitex per filament. The fiber would be a hard yarn which is conventionally fully drawn and annealed having strength and low shrinkage. As noted above, fibers hardened by high speed melt spinning may be suitable for the present invention. The fabric properties may also be modified by variations of the fiber cross sections.

A number of Examples of the present invention have been prepared as follows

EXAMPLES 1–37

Fabric samples were made with a lab batch wet-lay apparatus with meltspun PET fiber cut to 5 mm. The fiber was manufactured by Teijen Fibers and is commercially available. All samples were treated with an acrylic binder (Barriercoat 1708) to provide the sample with strength and finished with a repellent finish (Freepel 114, Zonyl 8315, NaCl, Isopropyl Alcohol) to give hydrophobic properties. Fiber size is below reported as decitex for round cross sectional fiber. As noted above, the fiber in the present invention need not necessarily be round. Thus, it may be more clear to recognize that decitex is a measure of both polymer density and cross sectional area of the fibers. Thus, for a 0.333 decitex (0.3 denier) PET fiber (2GT polyester) the cross sectional area is about 25 microns ($\mu M^2$). A 0.867 decitex PET fiber will have a 65 micron cross sectional area.

The data are tabulated below:

TABLE I

| | Ex. 1 | Ex. 2 | Ex. 3 | Ex. 4 |
|---|---|---|---|---|
| Basis Weight (g/$m^2$) | 44.1 | 44.1 | 44.1 | 44.1 |
| Fiber Size (decitex) | 0.333 | 0.333 | 0.333 | 0.333 |
| Thickness (mm) | 0.33 | 0.34 | 0.36 | 0.38 |
| Frazier Permeability ($m^3$/min-$m^2$) | 27.7 | 29.3 | 32.0 | 36.6 |
| Hydrostatic Head (cm) | 45 | 47 | 44 | 44.5 |
| Density (gm/cc) | 0.1336 | 0.1287 | 0.1241 | 0.1158 |
| Void (%) | 90.18 | 90.54 | 90.88 | 91.49 |

TABLE II

| | Ex. 5 | Ex. 6 | Ex. 7 | Ex. 8 |
|---|---|---|---|---|
| Basis Weight (g/m$^2$) | 44.1 | 44.1 | 44.1 | 44.1 |
| Fiber Size (decitex) | 0.333 | 0.333 | 0.333 | 0.333 |
| Thickness (mm) | 0.38 | 0.41 | 0.48 | 0.56 |
| Frazier Permeability (m$^3$/min-m$^2$) | 44.8 | 43.6 | 42.1 | 51.2 |
| Hydrostatic Head (cm) | 40 | 40.5 | 39.5 | 38.5 |
| Density (gm/cc) | 0.1158 | 0.1086 | 0.0914 | 0.0789 |
| Void (%) | 91.49 | 92.02 | 93.28 | 94.19 |

TABLE III

| | Ex. 9 | Ex. 10 | Ex. 11 | Ex. 12 |
|---|---|---|---|---|
| Basis Weight (g/m$^2$) | 44.1 | 44.1 | 54.2 | 64.4 |
| Fiber Size (decitex) | 0.333 | 0.333 | 0.333 | 0.333 |
| Thickness (mm) | 0.58 | 0.58 | 0.63 | 0.53 |
| Frazier Permeability (m$^3$/min-m$^2$) | 45.1 | 56.4 | 46.6 | 25.3 |
| Hydrostatic Head (cm) | 41 | 34.33 | 35 | 46.5 |
| Density (gm/cc) | 0.0755 | 0.0755 | 0.0855 | 0.1209 |
| Void (%) | 94.45 | 94.45 | 93.71 | 91.11 |

TABLE IV

| | Ex. 13 | Ex. 14 | Ex. 15 | Ex. 16 |
|---|---|---|---|---|
| Basis Weight (g/m$^2$) | 64.4 | 43.1 | 43.4 | 53.6 |
| Fiber Size (decitex) | 0.333 | 0.867 | 0.867 | 0.867 |
| Thickness (mm) | 0.79 | 0.43 | 0.41 | 0.41 |
| Frazier Permeability (m$^3$/min-m$^2$) | 38.1 | 73.8 | 65.2 | 50.0 |
| Hydrostatic Head (cm) | 38 | 28 | 31 | 32 |
| Density (gm/cc) | 0.0819 | 0.0998 | 0.1069 | 0.1319 |
| Void (%) | 93.98 | 92.66 | 92.14 | 90.30 |

TABLE V

| | Ex. 17 | Ex. 18 | Ex. 19 | Ex. 20 |
|---|---|---|---|---|
| Basis Weight (g/m$^2$) | 54.2 | 62.0 | 63.4 | 50.56 |
| Fiber Size (decitex) | 0.867 | 0.867 | 0.867 | 0.11 |
| Thickness (mm) | 0.46 | 0.51 | 0.46 | 0.18 |
| Frazier Permeability (m$^3$/min-m$^2$) | 57.9 | 50.3 | 43.3 | 4.74 |
| Hydrostatic Head (cm) | 29 | 30 | 33 | 72 |
| Density (gm/cc) | 0.1188 | 0.1223 | 0.1388 | |
| Void (%) | 91.27 | 91.01 | 89.79 | |

TABLE VI

| | Ex. 21 | Ex. 22 | Ex. 23 | Ex. 24 |
|---|---|---|---|---|
| Basis Weight (g/m$^2$) | 48.53 | 49.55 | 71.27 | 75.34 |
| Fiber Size (decitex) | 0.11 | 0.11 | 0.11 | 0.11 |
| Thickness (mm) | 0.20 | 0.20 | 0.23 | 0.30 |
| Frazier Permeability (m$^3$/min-m$^2$) | 9.12 | 8.57 | 3.04 | 5.17 |
| Hydrostatic Head (cm) | 73 | 60 | 99 | 77 |

TABLE VII

| | Ex. 25 | Ex. 26 | Ex. 27 | Ex. 28 |
|---|---|---|---|---|
| Basis Weight (g/m$^2$) | 73.64 | 52.60 | 55.32 | 52.60 |
| Fiber Size (decitex) | 0.11 | 0.33 | 0.33 | 0.33 |

TABLE VII-continued

| | Ex. 25 | Ex. 26 | Ex. 27 | Ex. 28 |
|---|---|---|---|---|
| Thickness (mm) | 0.30 | 0.20 | 0.30 | 0.36 |
| Frazier Permeability (m$^3$/min-m$^2$) | 4.86 | 15.14 | 25.69 | 31.62 |
| Hydrostatic Head (cm) | 63.5 | 48 | 43 | 38.5 |

TABLE VIII

| | Ex. 29 | Ex. 30 | Ex. 31 | Ex. 32 |
|---|---|---|---|---|
| Basis Weight (g/m$^2$) | 70.93 | 75.68 | 75.68 | 53.96 |
| Fiber Size (decitex) | 0.33 | 0.33 | 0.33 | 0.56 |
| Thickness (mm) | 0.23 | 0.38 | 0.56 | 0.20 |
| Frazier Permeability (m$^3$/min-m$^2$) | 8.63 | 18.6 | 24.02 | 16.84 |
| Hydrostatic Head (cm) | 55.5 | 46.5 | 41.5 | 40.5 |

TABLE IX

| | Ex. 33 | Ex. 34 | Ex. 35 | Ex. 36 |
|---|---|---|---|---|
| Basis Weight (g/m$^2$) | 54.64 | 52.94 | 76.70 | 67.87 |
| Fiber Size (decitex) | 0.56 | 0.56 | 0.56 | 0.56 |
| Thickness (mm) | 0.30 | 0.38 | 0.25 | 0.38 |
| Frazier Permeability (m$^3$/min-m$^2$) | 40.74 | 45.60 | 10.49 | 31.92 |
| Hydrostatic Head (cm) | 33 | 31 | 44 | 34 |

TABLE X

| | Ex. 37 |
|---|---|
| Basis Weight (g/m$^2$) | 76.02 |
| Fiber Size (decitex) | 0.56 |
| Thickness (mm) | 0.56 |
| Frazier Permeability (m$^3$/min-m$^2$) | 33.44 |
| Hydrostatic Head (cm) | 32.5 |

EXAMPLES 38–40

Fabric samples 38–40 were "hand-made" using polypropylene continuous fibers with diameters as indicated in Table XI. The samples were hot pressed as at the Bonding temperatures as indicated in Table XI.

TABLE XI

| | Ex. 38 | Ex. 39 | Ex. 40 |
|---|---|---|---|
| Basis Weight (g/m$^2$) | 59.3 | 48.1 | 51.9 |
| Fiber Size ($\mu$m) | 20 | 20 | 14–18 |
| Bonding Temp (°C.) | 152 | 154 | 154 |
| Frazier Permeability (m$^3$/min-m$^2$) | 75.0 | 60.0 | 288.3 |
| Hydrostatic Head (cm) | 20.1 | 15.0 | 17.0 |

EXAMPLES 41 and 42

Fabric samples 41 and 42 were "hand-made" similar to Examples 38–40 except that the fabric is made by using two plies of the hand-made samples. The data from samples 41 and 42 are set forth in Table XII.

TABLE XII

| | Ex. 41 | Ex. 42 |
|---|---|---|
| Basis Weight (g/m$^2$) | 128.8 | 101.7 |
| Fiber Size ($\mu$m) | 14–18 | 20 |
| Bonding Temp (°C.) | 154 | 154 |
| Frazier Permeability (m$^3$/min-m$^2$) | 35.1 | 20.7 |
| Hydrostatic Head (cm) | 158.0 | 228.1 |

The data from Tables XI and XII clearly indicate that a unique combination of barrier and air permeability may be formed by the inventive fabric which is not found in other available nonwoven fabrics. The uses of such fabrics and structures may be exceptionally broad as the combination or balance of properties has never really been anticipated in a single fabric. Principally, the fabric may be used in special use apparel such as a medical gown for a surgeon. It would be for a single use to protect the surgeon or other medical personnel from hazardous liquids such as contaminated body fluids. However, during a long and intense operation, the medical personnel would not be overheating but rather would be quite comfortable in a garment that breathes. After use, the garment would preferably be fully recyclable as it would be constituted of a single polymer which would be readily recycled back to constituent monomer as compared to other materials which are combinations of dissimilar polymers or wherein at least one constituent is not a recyclable polymer.

Although there are disclosed a number of examples related to wetlay nonwoven fabrics and then discussion of fibers that may be spun into strong, stable fibers without annealing and drawing, the combination of both aspects of the invention into a nonwoven fabric made directly from strong, stable fiber as the fiber is spun and which avoids the need for annealing and drawing would be at least one preferred arrangement of the invention.

There are several additional aspects to preferred arrangements of the invention. The small denier fiber may be spun as a bicomponent conjugate fiber or multi-component conjugate fiber and split into finer fibers after the fibers are spun. One advantage of spinning conjugate fibers is higher potential production rates depending on the mechanism for splitting the conjugate fibers. Each of the resulting split fibers may have a pie shaped or other shaped cross section.

Figure 6:
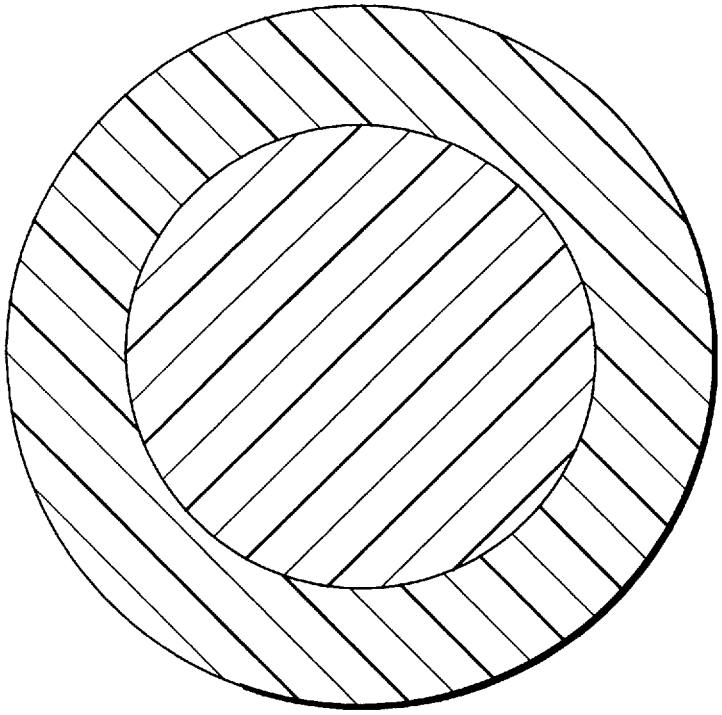
FIG. 6 is an enlarged cross sectional view of a sheath-core bi-component fiber.

Another aspect is to provide bicomponent or polymers such as sheath-core arrangements. A sheath-core bi-component fiber is illustrated in FIG. 6 where a fiber 80 is shown in cross section. The sheath polymer 82 surrounds the core polymer 84 and the relative amounts of polymer may be adjusted so that the core polymer 84 may comprise more or less than fifty percent of the cross sectional area. With this arrangement, a number of attractive alternatives can be produced. For example, the sheath polymer 82 can be blended with pigments which are not wasted in the core, thereby reducing the costs for pigments while obtaining a suitably colored material. A hydrophobic material such as a fluorocarbon may also be spun into the sheath polymer to obtain the desired liquid repellency at minimal cost. An antimicrobial additive may be suitable in some healthcare applications. Stabilizers may be provided for a number of applications such as ultraviolet energy exposure, where outdoor exposure to sunlight may be one example. A static electricity discharge additive may be used for applications where a build up of electricity is possible and undesirable. Another additives may be suitable such as a wetting agent to make the sheet material suitable as a wipe or absorbent or to allow liquids to flow through the fabric while very fine solids are collected in the fine pores of the sheet material. As the sheet material is proposed to be comprised of generally continuous filaments, the sheet material may be amenable as a wipe having low Tinting characteristics.

A polymer having a lower melt point or melting temperature may be used as the sheath to so as to be amenable to melting during bonding while the core polymer does not soften. One very interesting example is a sheath core arrangement using 2GT polyester as the core and 3GT polyester as the sheath. Such an arrangement would be suited for radiation sterilization such as e-beam and gamma ray sterilization without degradation. Other combinations of multi-component fibers and blends of fibers may be envisioned. Various polymers present challenges and opportunities. The sheet material of the present invention may comprise polyester (such as polyethylene teraphthalate, polypropylene teraphthalate, and polybutylene teraphthalate) combinations and blends of polyester, nylon, a polyolefin such as polyethylene and polypropylene, and even elastomeric polymers.

The foregoing description and drawings were intended to explain and describe the invention so as to contribute to the public base of knowledge. In exchange for this contribution of knowledge and understanding, exclusive rights are sought and should be respected. The scope of such exclusive rights should not be limited or narrowed in any way by the particular details and preferred arrangements that may have been shown. Clearly, the scope of any patent rights granted on this application should be measured and determined by the claims that follow.

We claim:

1. A flexible sheet material having a Frazier permeability of at least about 70 m$^3$/min-m$^2$ and an unsupported hydrostatic head of at least about 15 cm.

2. The flexible sheet material according to claim 1 wherein the hydrostatic head is at least about 20 cm.

3. A flexible sheet material having a Frazier permeability of at least about 28 m$^3$/min-m$^2$ and an unsupported hydrostatic head of at least about 30 cm.

4. A flexible sheet material having a Frazier permeability of at least about 15 m$^3$/min-m$^2$ and a hydrostatic head of at least about 40 cm.

5. A flexible sheet material having a combination of Frazier permeability and hydrostatic head properties selected from the group of:

- a Frazier permeability of at least 70 m$^3$/min-m$^2$ and an unsupported hydrostatic head of at least about 15 cm;
- a Frazier permeability of at least 28 m$^3$/min-m$^2$ and an unsupported hydrostatic head of at least about 30 cm;
- a Frazier permeability of at least 15 m$^3$/min-m$^2$ and an unsupported hydrostatic head of at least about 40 cm; and
- a Frazier permeability of at least 1 m$^3$/min-m$^2$ and an unsupported hydrostatic head of at least about 80 cm.

6. A flexible sheet material comprised of meltspun nonwoven fibers having an average length of at least about 4 cm and wherein a substantial majority of the fibers have a cross section of less than about 70 square microns and the average fiber strength is at least 275 N/mm$^2$.

7. A flexible sheet material formed of nonwoven fibers where in the sheet has a basis weight of at least about 13 g/m$^2$ up to about 75 g/m$^2$, and wherein substantially all of the fibers are meltspun fibers, a substantial majority by weight of the fibers have a cross section of less than about 90 square microns, and wherein the sheet material has a Frazier permeability is at least about 1 $m^3$/min-$m^2$ and a hydrostatic head of at least about 25 cm.

8. The sheet material according to claim 7 wherein the hydrostatic head is at least 30 cm.

9. The sheet material according to claim 7 wherein the hydrostatic head is at least 40 cm.

10. The sheet material according to any one of claims 5, 6, and 7 wherein the Frazier permeability is at least about 5 $m^3$/min-$m^2$.

11. The sheet material according to any one of claims 5 and 7 wherein the Frazier permeability is at least about 10 $m^3$/min-$m^2$.

12. The sheet material according to any one of claims 5 and 7 wherein the Frazier permeability is at least 15 $m^3$/min-$m^2$.

13. The sheet material according to any one of claims 4, 5 and 7 wherein the Frazier permeability is at least 25 $m^3$/min-$m^2$.

14. The sheet material according to any one of claims 3, 4, 5 and 7 wherein the Frazier permeability is at least 35 $m^3$/min-$m^2$.

15. The sheet material according to any one of claims 3, 4 and 7 wherein the Frazier permeability is at least about 45 $m^3$/min-$m^2$.

16. The sheet material according to any one of claims 3, 4, and 7 wherein the hydrostatic head is at least 50 cm.

17. The sheet material according to any one of claims 3, 4, and 7 wherein the hydrostatic head is at least 60 cm.

18. The sheet material according to any one of claims 1, 3, 4, and 5 wherein the sheet material is comprised of fibers wherein the average fiber size is less than about 90 $\mu m^2$.

19. The sheet material according to any one of claims 1, 3, 4, 5, and 7 wherein the sheet material is comprised of fibers wherein the average fiber size is less than about 75 $\mu m^2$.

20. The sheet material according to any one of claims 1, 3, 4, 5, 6 and 7 wherein the sheet material is comprised of fibers wherein the average fiber size is less than about 60 $\mu m^2$.

21. The sheet material according to any one of claims 1, 3, 4, 5, and 7 wherein the sheet material is comprised of fibers having a minimum fiber strength of about 275 newtons per square millimeter.

22. The sheet material according to any one of claims 1, 3, 4, 5, 6, and 7 wherein the sheet has a grab tensile strength of at least about 1 N/g/$m^2$.

23. The sheet material according to any of claims 1, 3, 4, 5, 6, and 7 wherein the sheet material is comprised of fibers and wherein the majority of fibers have a boil off shrinkage of less than ten percent.

24. The sheet material according to any of claims 1, 3, 4, 5, 6, and 7 wherein the sheet material is comprised of fibers which are split fibers from larger conjugate melt spun fibers.

25. The sheet material according to any of claims 1, 3, 4, 5, 6, and 7 wherein the sheet material is comprised of fibers, and at least a portion of the fibers are formed of at least two separate component polymers.

26. The sheet material according to claim 25 wherein one of said components overlies the other in a sheath-core arrangement.

27. The sheet material according to claim 26 wherein the sheath component of the fibers includes at least one additive blended into the polymer.

28. The sheet material according to claim 27 wherein the additive is a hydrophobic additive to repel liquids.

29. The sheet material according to claim 28 wherein the additive is a fluorocarbon.

30. The sheet material according to claim 27 wherein the additive is a stabilizer.

31. The sheet material according to claim 30 wherein the stabilizer is a stabilizing agent for ultraviolet energy exposure.

32. The sheet material according to claim 28 wherein the additive is a wetting agent to cause mechanical absorption of liquids into the fabric.

33. The sheet material according to claim 28 wherein the additive provides a color to the fibers and fabric.

34. The sheet material according to claim 28 wherein the additive reduces the buildup of static electricity in the fabric.

35. The sheet material according to claim 28 wherein the additive is an antimicrobial agent.

36. The sheet material according to claim 27 wherein the polymer comprising the sheath has a lower melting temperature than the polymer comprising the core.

37. The sheet material according to claim 27 wherein the polymer comprising the sheath does not substantially degrade from exposure to radiation sterilization processing.

38. The sheet material according to any of claims 1, 3, 4, 5, 6, and 7 wherein the sheet is comprised of fibers and a first portion of the fibers is comprised of a first polymer and a second portion is formed of a second polymer, wherein one of said first and second polymers melts at a lower temperature than the other to facilitate thermal bonding.

39. The sheet material according to any of claims 1, 3, 4, 5, 6, and 7 wherein the sheet is comprised of fibers and the fibers comprise polyester polymer.

40. The sheet material according to claim 39 wherein the fibers are comprised of polyethylene terephthalate polymer.

41. The sheet material according to claim 39 wherein the fibers are comprised of polypropylene terephthalate polymer.

42. The sheet material according to claim 39 wherein the fibers are comprised of polybutylene terephthalate polymer.

43. The sheet material according to claim 39 wherein the fibers are comprised of polyester with an additional polymer blended with the polyester polymer.

44. The sheet material according to any of claims 1, 3, 4, 5, 6, and 7 wherein the sheet is comprised of fibers and the fibers comprise nylon polymer.

45. The sheet material according to any of claims 1, 3, 4, 5, 6, and 7 wherein the sheet is comprised of fibers and the fibers comprise polyethylene polymer.

46. The sheet material according to any of claims 1, 3, 4, 5, 6, and 7 wherein the sheet is comprised of fibers and the fibers comprise polypropylene polymer.

47. The sheet material according to any of claims 1, 3, 4, 5, 6, and 7 wherein the sheet material is comprised of fibers and the fibers are comprised of elastomeric polymer.

48. The sheet material according to any of claims 1, 3, 4, 5, 6, and 7 wherein the sheet is comprised of fibers and the fibers comprise a blend of different polymers.

49. The sheet material according to any of claims 1, 3, 4, 5, 6, and 7 wherein the sheet is comprised of fibers and the fibers comprise at least one additive blended into the polymer.

50. The sheet material according to claim 49 wherein the additive is a hydrophobic additive to repel liquids.

51. The sheet material according to claim 49 wherein the additive is a fluorocarbon.

52. The sheet material according to claim 49 wherein the additive is a stabilizer.

53. The sheet material according to claim 52 wherein the stabilizer is a stabilizing agent for ultraviolet energy exposure.

54. The sheet material according to claim 49 wherein the additive is a wetting agent to increase mechanical absorption of liquids into the fabric.

55. The sheet material according to claim 49 wherein the additive provides a color to the fibers and fabric.

56. The sheet material according to claim 49 wherein the additive reduces the buildup of static electricity in the fabric.

57. The sheet material according to claim 49 wherein the additive is an antimicrobial agent.

58. The sheet material according to any of claims 1, 3, 4, 5, 6, and 7 wherein the sheet material is formed of fibers with a repellent finish applied thereon.

59. The sheet material according to claim 58 wherein said repellent finish comprises a fluorocarbon.

60. The sheet material according to any of claims 1, 3, 4, 5, and 7 wherein the sheet material is comprised of melt extruded generally continuos filament polymer fibers.

61. The sheet material according to claim 60 wherein the fibers are ultrasonically bonded together.

62. The sheet material according to claim 60 wherein the fibers which are thermally bonded together.

63. The sheet material according to claim 60 wherein the sheet material is comprised of fibers which are adhesively bonded together.

64. The sheet material according to any of claims 1, 3, 4, 5, 6, and 7 wherein the material has a cross sectional void percentage of at least about 85 percent.

65. The sheet material according to claim 64 wherein the material has a cross sectional void percentage of at least about 89 percent.

66. The sheet material according to any of claims 1, 3, 4, 5, 6, and 7 wherein the polymer does not substantially degrade due to exposure to radiation sterilization processing.

67. The sheet material according to claim 66 wherein the polymer does not substantially degrade due to exposure to gamma radiation.

68. The sheet material according to claim 66 wherein the polymer does not substantially degrade due to exposure to e-beam radiation.

69. The sheet material according to any of claims 1, 3, 4, 5, and 7 wherein the sheet material is comprised of layers of fibers forming a nonwoven sheet and wherein all of the layers are direct laid meltspun generally continuous fibers.

70. The sheet material according to any of claims 1, 3, 4, 5, and 6 wherein the basis weight is greater than 13 grams per square meter and less than 100 grams per square meter.

71. The sheet material according to claim 5 wherein the basis weight is greater than 65 grams per square meter and less than 250 grams per square meter.

72. A radiation sterilization stable sheath-core bi-component fiber suited for making a thermally bonded nonwoven fabric wherein the core polymer is polyethylene teraphthalate and the sheath fiber is polypropylene teraphthalate.

73. The radiation sterilization stable sheath-core bi-component fiber according to claim 72 wherein the sheath polymer includes pigment blended therein and the core polymer is generally free of pigment.

74. The radiation sterilization stable sheath-core bi-component fiber according to claim 73 wherein the sheath polymer further includes a fluorocarbon blended therein.

75. The radiation sterilization stable sheath-core bi-component fiber according to claim 73 wherein the average cross sectional area of the fiber is less than 90 square microns.

* * * * *